US010597198B2

(12) United States Patent
Dais et al.

(10) Patent No.: US 10,597,198 B2
(45) Date of Patent: Mar. 24, 2020

(54) RECLOSABLE VACUUM-TIGHT POUCH AND RESEALABLE VACUUM-TIGHT CLOSURE MECHANISM THEREFOR

(75) Inventors: Brian C. Dais, Saginaw, MI (US); Jose Porchia, Greenfield, WI (US); Brent G. Anderson, Barrington, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 961 days.

(21) Appl. No.: 12/146,015

(22) Filed: Jun. 25, 2008

(65) Prior Publication Data

US 2009/0324141 A1 Dec. 31, 2009

(51) Int. Cl.
*B65D 33/16* (2006.01)
*B65D 33/25* (2006.01)

(52) U.S. Cl.
CPC ..... *B65D 33/2508* (2013.01); *B65D 33/2541* (2013.01)

(58) Field of Classification Search
CPC ..... B65D 33/2508; B65D 33/2541; B65D 33/255; B65D 33/2591; B65D 61/188;
(Continued)

(56) References Cited

U.S. PATENT DOCUMENTS 3,440,696 A * 4/1969 Staller ..... 24/586.1
3,565,147 A 2/1971 Ausnit
(Continued)

FOREIGN PATENT DOCUMENTS

JP 3094269 4/2000
JP 3294043 5/2002

*Primary Examiner* — Jes F Pascua
*Assistant Examiner* — Matthew T Theis

(57) ABSTRACT

A resealable vacuum-tight closure mechanism has a first closure element that includes a first base and a second closure element that includes a second base. A first contact surface on a first interlocking profile depends from the first base and a second contact surface on a second interlocking profile depends from the second base. The first and second contact surfaces provide a maximum occlusion distance when the first and second interlocking profiles are in an occluded state. A first sealing member extends from the first base, has a first length, is spacedly disposed from the first interlocking profile, and has a first sealing surface disposed thereon. A second sealing member extends from the second base, has a second length, is spacedly disposed from the second interlocking profile, and has a second sealing surface disposed thereon that is complementary to the first sealing surface. A sealing reservoir protrusion is disposed between the first sealing member and the first interlocking profile and has a volume sufficient to form a first gastight seal in a first occluded space between the first and second closure elements and bounded by the first and second occluded sealing members and the first and second occluded interlocking profiles upon formation of an end-stomp at an end of the first and second closure elements. A sum of the first and second lengths of the respective first and second sealing members is greater than or about equal to a length necessary to maintain a second gastight seal between the first and second sealing surfaces when the first and second interlocking profiles are in the occluded state.

15 Claims, 11 Drawing Sheets

(58) Field of Classification Search
CPC ..... A44B 19/16; A44B 19/32; Y10S 24/50; Y10S 24/2532; Y10S 24/2514; Y10S 24/2534
USPC ..... 383/59, 61.2, 63; 24/585.1, 585.12, 400, 24/DIG. 50
See application file for complete search history.

(56) References Cited

U.S. PATENT DOCUMENTS

| | | | | | |
|---|---|---|---|---|---|
| 3,918,131 | A | | 11/1975 | Ausnit | |
| 4,672,723 | A | | 6/1987 | Hugues et al. | |
| 4,787,880 | A | * | 11/1988 | Ausnit | B65D 33/2541 383/63 |
| 5,017,021 | A | | 5/1991 | Simonsen et al. | |
| 5,211,481 | A | | 5/1993 | Tilman | |
| 5,489,252 | A | | 2/1996 | May | |
| 5,558,439 | A | | 9/1996 | Tilman | |
| 5,577,305 | A | | 11/1996 | Johnson | |
| 5,689,866 | A | | 11/1997 | Kasai et al. | |
| 6,004,032 | A | * | 12/1999 | Kapperman et al. | 383/5 |
| 6,033,113 | A | | 3/2000 | Anderson | |
| 6,167,597 | B1 | | 1/2001 | Malin | |
| 6,185,796 | B1 | | 2/2001 | Ausnit | |
| 6,691,383 | B2 | | 2/2004 | Linton | |
| 6,854,886 | B2 | | 2/2005 | Piechocki et al. | |
| 2004/0234172 | A1 | * | 11/2004 | Pawloski | 383/61.2 |
| 2005/0141786 | A1 | * | 6/2005 | Piechocki et al. | 383/59 |
| 2006/0048483 | A1 | * | 3/2006 | Tilman et al. | 53/434 |
| 2006/0165316 | A1 | | 7/2006 | Cheung | |

* cited by examiner

RECLOSABLE VACUUM-TIGHT POUCH AND RESEALABLE VACUUM-TIGHT CLOSURE MECHANISM THEREFOR

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

FIELD OF THE INVENTION

The present disclosure relates generally to a resealable closure mechanism, and more particularly to a gastight resealable closure mechanism such as may be used on a vacuum sealable container.

BACKGROUND OF THE INVENTION

Resealable closure mechanisms are commonly used on containers that may be used to store perishable contents, such as food. It may be advantageous for such a resealable closure mechanism to form a gastight seal when occluded, because a gastight seal allows the container to be evacuated and vacuum sealed. For example, after the container has been loaded with the perishable contents, a user may evacuate the container of excess gas, for example through an evacuation valve, and vacuum seal the container by occluding the gastight closure mechanism. Perishable contents stored within a vacuum sealed container may remain fresher for a longer period of time than if otherwise stored in the presence of larger amounts of gas, such as air, in an un-vacuumed container. Resealable closure mechanisms have been used to facilitate maintenance of vacuum in containers for an extended period of time.

For example, one such resealable closure mechanism has a first closure element that has first and second interlocking profiles disposed on either side of a first sealing member that is compressible. A second closure element has third and fourth interlocking profiles that interlock with the first and second interlocking profiles, respectively. When the first and second closure elements are occluded, the first sealing member is compressed against the second closure element to create a seal therebetween.

Another resealable closure mechanism has a first closure element with two male interlocking profiles and a second closure element with two female interlocking profiles. At least one of the first and second closure elements also includes high compression members disposed on opposite ends of the closure element or a high compression member disposed between the interlocking profiles. The high compression members are sufficiently long to make contact with the opposing closure element during occlusion of the closure elements before the extremities of the interlocking profiles on either of the first and second closure elements contact the opposite closure element. The high compression members prevent damage or distortion that may be caused to the interlocking profiles during sealing of thermoplastic film to bases of the closure elements.

Further resealable closure mechanisms have opposing first and second closure elements. Each closure element has a sealing member disposed between two interlocking members. The sealing members press against each other to form a seal when the interlocking members are interlocked. In one such closure mechanism, for example, the first closure element has two spaced out-turned male hooks that interlock with two complementary in-turned female hooks disposed on the second closure element. A pressing rib spaced between the out-turned male hooks is wedged into a tapered channel defined by two tightening walls spaced between the in-turned female hooks. Each tightening wall also presses against an inner surface of the adjacent out-turned male hook.

Other resealable closure mechanisms have rounded male and female interlocking profiles. For example, one such closure mechanism has a first closure element with male and female interlocking profiles that respectively interlock with female and male interlocking profiles disposed on a second closure element. Each male profile has a neck and a head and a round zipping groove between the neck and head on each side of the neck. Each female profile has a pair of locking arms, each having a round hooking end. The hooking ends and zipping grooves are congruently rounded such that they form a seal therebetween when each male profile is pressed into the corresponding female profile. In another such closure mechanism, a female profile further includes a central sealing arm disposed between the locking arms. The central sealing arm is sealedly inserted into a coupling groove disposed along a center line of a corresponding male profile when the female profile and the male profile are interlocked.

A flexible reclosable pouch, for example, a thermoplastic pouch, that has a resealable closure mechanism applied across a mouth of the pouch may maintain a gastight seal along a majority of the resealable closure mechanism. However such a resealable closure mechanism applied to the reclosable pouch may suffer from leaks at ends of the closure mechanism where post application crushing and slicing occurs during the pouch manufacture.

SUMMARY OF THE DISCLOSURE

According to one aspect of the disclosure, a resealable vacuum-tight closure mechanism comprises a first closure element that includes a first base and a second closure element that includes a second base. A first contact surface on a first interlocking profile depends from the first base and a second contact surface on a second interlocking profile depends from the second base. The first and second contact surfaces provide a maximum occlusion distance when the first and second interlocking profiles are in an occluded state. A first sealing member extends from the first base, has a first length, is spacedly disposed from the first interlocking profile, and has a first sealing surface disposed thereon. A second sealing member extends from the second base, has a second length, is spacedly disposed from the second interlocking profile, and has a second sealing surface disposed thereon that is complementary to the first sealing surface. A sealing reservoir protrusion is disposed between the first sealing member and the first interlocking profile and has a volume sufficient to form a first gastight seal in a first occluded space between the first and second closure elements and bounded by the first and second occluded sealing members and the first and second occluded interlocking profiles upon formation of an end-stomp at an end of the first and second closure elements. A sum of the first and second lengths of the respective first and second sealing members is greater than or about equal to a length necessary to maintain a second gastight seal between the first and second sealing surfaces when the first and second interlocking profiles are in the occluded state.

According to another aspect of the disclosure, a resealable vacuum-tight closure mechanism comprises a first closure element that includes a first base and a second closure element that includes a second base. A first contact surface is disposed on a first interlocking profile depending from the first base and a third contact surface is disposed on a third interlocking profile depending from the second base. The first and third contact surfaces provide a first maximum occlusion distance when the first and third interlocking profiles are in a first occluded state. A second contact surface is disposed on a second interlocking profile depending from the first base and a fourth contact surface is disposed on a fourth interlocking profile depending from the second base. The second and fourth contact surfaces provide a second maximum occlusion distance when the second and fourth interlocking profiles are in a second occluded state. A first sealing member extends from the first base, has a first length, is spacedly disposed between the first and second interlocking profiles, and has a first sealing surface disposed thereon. A second sealing member extends from the second base, has a second length, is spacedly disposed between the third and fourth interlocking profiles, and has a second sealing surface disposed thereon that is complementary to the first sealing surface. A sealing reservoir protrusion is disposed between the first sealing member and the second interlocking profile and/or between the first sealing member and the first interlocking profile and has a volume sufficient to respectively form a first gastight seal in a first occluded space between the first and second closure elements and between the first and second occluded sealing members and the second and fourth occluded interlocking profiles and/or form a second gastight seal in a second occluded space between the first and second closure elements and between the first and second occluded sealing members and the first and third occluded interlocking profiles upon formation of a gastight end-stomp at an end of the first and second closure elements. A sum of the first and second lengths is greater than or about equal to a length necessary to maintain a third gastight seal between the first and second sealing surfaces when the first and third and the second and fourth interlocking profiles are in the respective first and second occluded states.

According to yet another aspect of the present disclosure, a reclosable vacuum-tight pouch, comprises first and second pouch sidewalls joined together to define an interior and an opening of the pouch. A first closure element includes a first base having an interior side and an opening side and is attached to the first sidewall and a second closure element includes a second base having an interior side and an opening side and is attached to the second sidewall. A first contact surface is disposed on a first interlocking profile depending from the opening side of the first base and a third contact surface is disposed on a third interlocking profile depending from the opening side of the second base. The first and third contact surfaces provide a first maximum occlusion distance when the first and third interlocking profiles are in a first occluded state. A second contact surface is disposed on a second interlocking profile depending from the interior side of the first base and a fourth contact surface is disposed on a fourth interlocking profile depending from the interior side of the second base. The second and fourth contact surfaces provide a second maximum occlusion distance when the second and fourth interlocking profiles are in a second occluded state. A first sealing member extends from the first base, has a first length, is spacedly disposed between the first and second interlocking profiles, and has a first sealing surface disposed thereon. A second sealing member extends from the second base, has a second length, is spacedly disposed between the third and fourth interlocking profiles, and has a second sealing surface disposed thereon that is complementary to the first sealing surface. A sealing reservoir protrusion is disposed between the first sealing member and the second interlocking profile and has a volume sufficient to form a first gastight seal between the first and second closure elements and between the first and second occluded sealing members and the second and fourth occluded interlocking profiles upon formation of an end-stomp at an end of the first and second closure elements. A sum of the first and second lengths is greater than or about equal to a length necessary to maintain a second gastight seal between the first and second sealing surfaces when the first and third and the second and fourth interlocking profiles are in the respective first and second occluded states.

BRIEF DESCRIPTION OF THE DRAWINGS

Other aspects and advantages of the present disclosure will become apparent upon consideration of the following detailed description, wherein similar structures have the same reference numerals throughout.

DETAILED DESCRIPTION

The present disclosure is directed to a pouch and a leak-proof or gastight closure mechanism therefor. While specific embodiments are discussed herein, it is understood that the present disclosure is to be considered only as an exemplification of the principles of the disclosure. Therefore, the present disclosure is not intended to limit the disclosure to the embodiments illustrated.

Figure 1:
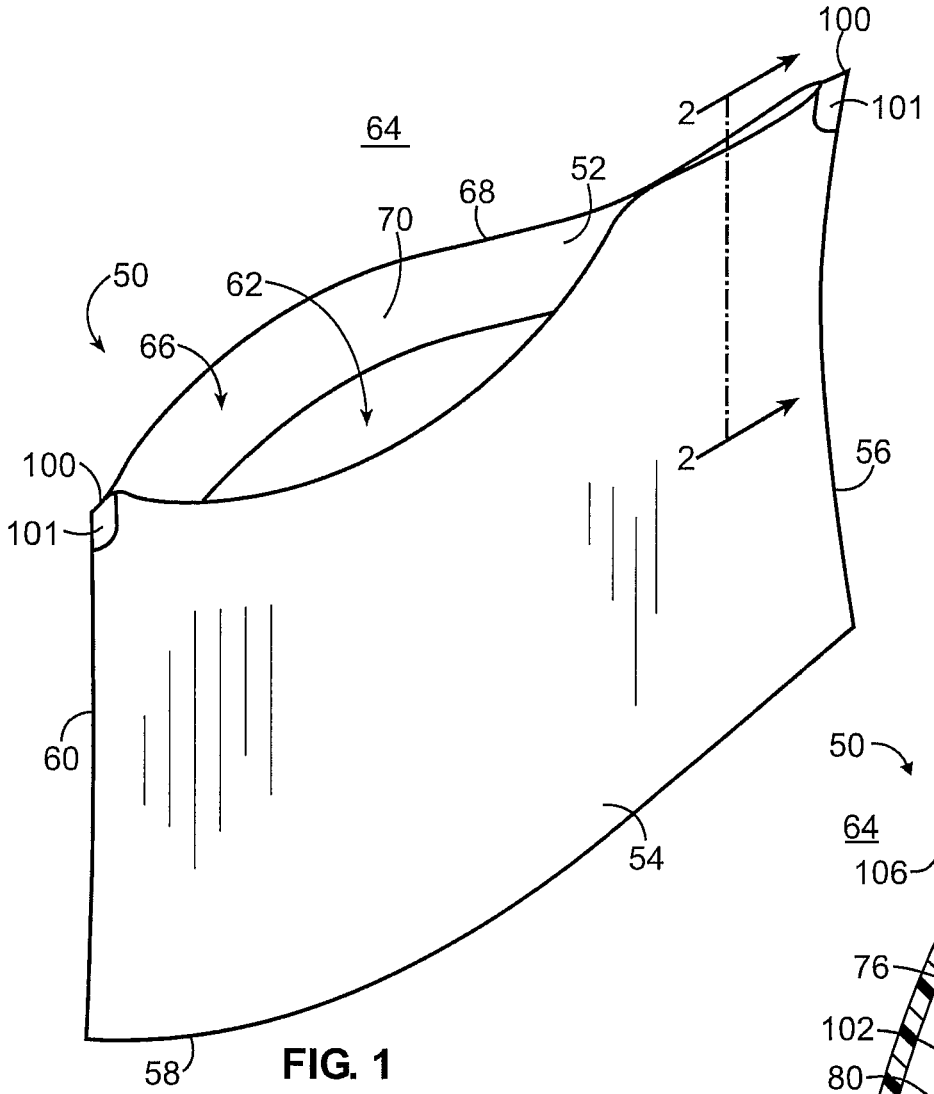
FIG. 1 is an isometric view of an embodiment of a flexible pouch with a resealable closure mechanism.

FIG. 1 illustrates a reclosable pouch 50 having a first sidewall 52 and a second sidewall 54 that are connected by, for example, folding, heat sealing, and/or an adhesive, along three peripheral edges 56, 58, 60 to define an interior space 62 between the first and second sidewalls 52, 54, an exterior space 64, and an opening 66 along a top edge 68 where the first and second sidewalls 52, 54 are not connected so as to allow access to the interior space 62 from the exterior space 64. A resealable closure mechanism 70 is disposed along the first and second sidewalls 52, 54 near the opening 66 and extends between the peripheral edge 56 and the peripheral edge 60 of the pouch 50 to allow the opening 66 to be repeatedly occluded and deoccluded, thereby respectively sealing and unsealing the opening 66.

When occluded, the resealable closure mechanism 70 provides a leak-proof or gastight seal such that a vacuum-tight seal may be maintained in the pouch interior 62 for a desired period of time, such as days, months, or years, when the closure mechanism is sealed fully across the opening 66. In one embodiment, the pouch 50 may include a second opening (not shown) through one of the sidewalls 52, 54 covered by a valve (not shown), such as a check or one-way valve, to allow air to be evacuated from the pouch interior 62 and maintain a vacuum when the resealable closure mechanism 70 has been sealed. Illustrative valves useful in the present disclosure include those disclosed in, for example, Newrones et al. U.S. Patent Application Publication No. 2006/0228057, Buchman U.S. Patent Application Publication No. 2007/0172157, and Tilman et al. U.S. Patent Application Publication No. 2007/0154118. Other valves useful in the present disclosure include those disclosed in, for example, U.S. patent application Ser. Nos. 11/818,586, 11/818,591, and 11/818,592, each filed on Jun. 15, 2007.

A portion of one or both surfaces of a sidewall may be embossed or textured (not shown) to define flow channels that allow fluid communication between a remote portion of the pouch interior 62 and a portion of the pouch interior proximate to the closure mechanism 70. The flow channels may facilitate evacuation of gas from the pouch interior 62 through the valve. Illustrative flow channels useful in the present disclosure include those disclosed in Zimmerman et al. U.S. Patent Application Publication No. 2005/0286808 and Tilman et al. U.S. Pat. No. 7,290,660. Other flow channels useful in the present disclosure include those disclosed in, for example, U.S. patent application Ser. No. 11/818,584, filed Jun. 15, 2007.

Although not shown, it is also contemplated that a vacuum device may be used to evacuate gas from the interior 62 of the pouch 50. For example, a vacuum device such as a manual or electric vacuum pump may be configured to be placed over the valve. A vacuum drawn on the valve allows gas to escape from the interior 62 through the valve via the flow channels. Illustrative evacuation pumps or devices useful in the present disclosure include those disclosed in, for example, U.S. patent application Ser. No. 11/818,703, filed on Jun. 15, 2007, and U.S. patent application Ser. No. 12/008,164, filed on Jan. 9, 2008. It is further contemplated that the pouch 50 may include a one-way valve disposed on at least one of the first and second pouch sidewalls and flow channels disposed on at least one of the first and second pouch sidewalls and in fluid communication with the one-way valve, and may be provided as a component of a kit or package that comprises a vacuum pump to evacuate gas from the interior of the pouch through the one-way valve.

Figure 2:
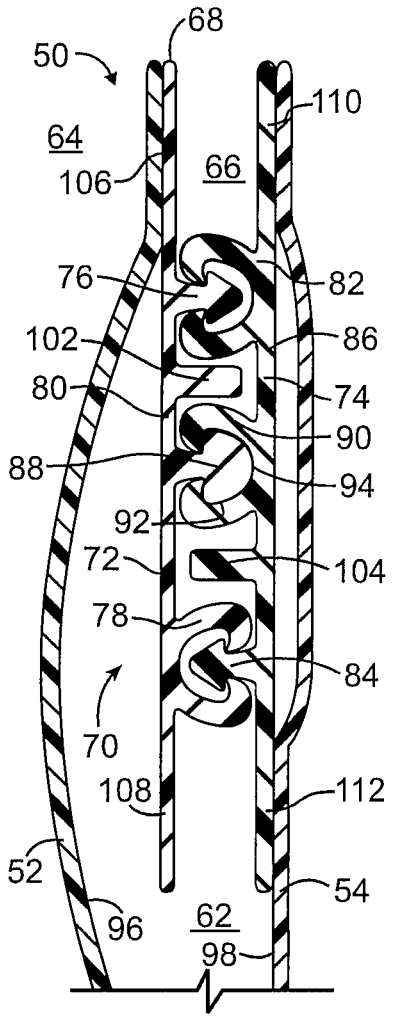
FIG. 2 is a partial cross-sectional of the pouch of FIG. 1, taken generally along the line 2-2 of FIG. 1, with portions behind the plane of the cross-section omitted for clarity.

Referring to FIG. 2, an embodiment of a resealable closure mechanism, for example, the resealable closure mechanism 70 is illustrated having first and second closure elements 72, 74. The first closure element 72 includes a first interlocking profile 76 and a second interlocking profile 78 disposed on an interior side of the first interlocking profile 76, each protruding from a first base 80. The second closure element 74 includes a third interlocking profile 82 and a fourth interlocking profile 84 disposed on an interior side of the third interlocking profile 82, each protruding from a second base 86. Each of the first, second, third, and fourth interlocking profiles 76, 78, 82, and 84 is depicted in FIG. 2 as a male or a female interlocking profile. However, the configuration and geometry of the interlocking profiles that comprise the resealable closure mechanism 70 may vary as known to those skilled in the art. For example, in one embodiment, one or both of the interlocking profiles may include bumps or grooves in order to provide a tactile sensation, such as a series of clicks, as a user draws the fingers along the closure mechanism 70 to seal the opening 66. Further, in some embodiments, a sealing material such as a polyolefin material or a caulking composition such as silicone grease may be disposed on or in the interlocking profiles to fill in gaps or spaces therein when occluded. The ends of the closure mechanism 70 may also be sealed to provide an end-stomp seal between the first and second closure elements 72, 74 by, for example, crushing, ultrasonic vibration, and/or application of heat as is known in the art. Illustrative interlocking profiles, sealing materials, tactile or audible closure elements, and/or end-stomps useful in the present disclosure include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, Pawloski U.S. Patent Application Publication No. 2004/0234172, Tilman et al. U.S.

Patent Application Publication No. 2006/0048483, and Anzini et al. U.S. Patent Application Publication Nos. 2006/0093242 and 2006/0111226. Other interlocking profiles useful in the present disclosure include those disclosed in, for example, U.S. patent application Ser. No. 11/725,120, filed Mar. 16, 2007, and U.S. patent application Ser. Nos. 11/818,586 and 11/818,593, each filed on Jun. 15, 2007. It is further appreciated that the resealable closure mechanism 70 disclosed herein may be operated by hand, or a slider (not shown) may be used to assist in occluding and de-occluding the interlocking profiles.

In one embodiment, the first and second sidewalls 52, 54 and/or the closure mechanism 70 are formed from thermoplastic resins by known extrusion methods. For example, the sidewalls 52, 54 may be independently extruded of thermoplastic material as a single continuous or multi-ply web, and the closure mechanism 70 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof.

A first sealing member 88 depends from the first base 80 and is spacedly disposed between the first and second profiles 76, 78. A second sealing member 90 depends from the second base 86 and is spacedly disposed between the third and fourth profiles 82, 84. The second sealing member 90 is disposed opposite the first sealing member 88 when the first and second closure elements 72, 74 are occluded. The first sealing member 88 includes a first sealing surface 92 that is complementary to a second sealing surface 94 of the second sealing member 90. This opposing disposition facilitates engagement of the first and second sealing surfaces 92, 94 and the formation of a gastight seal therebetween, when the first and second closure elements 72, 74 are occluded. In this embodiment the first sealing member 88 is depicted as having a bulbous head that sealingly engages a groove of the second sealing member 90. In other embodiments, the first and second sealing members 88, 90 may, for example, have other shapes that are the same or different from one another, may be compressible or hollow, or there may be a single sealing member disposed on the first or second closure element 72, 74 that engages and forms a gastight seal against the opposite closure element. Illustrative sealing members that may be useful in the present disclosure include those disclosed in, for example, Piechocki et al. U.S. Pat. No. 6,854,886.

Figure 3A:
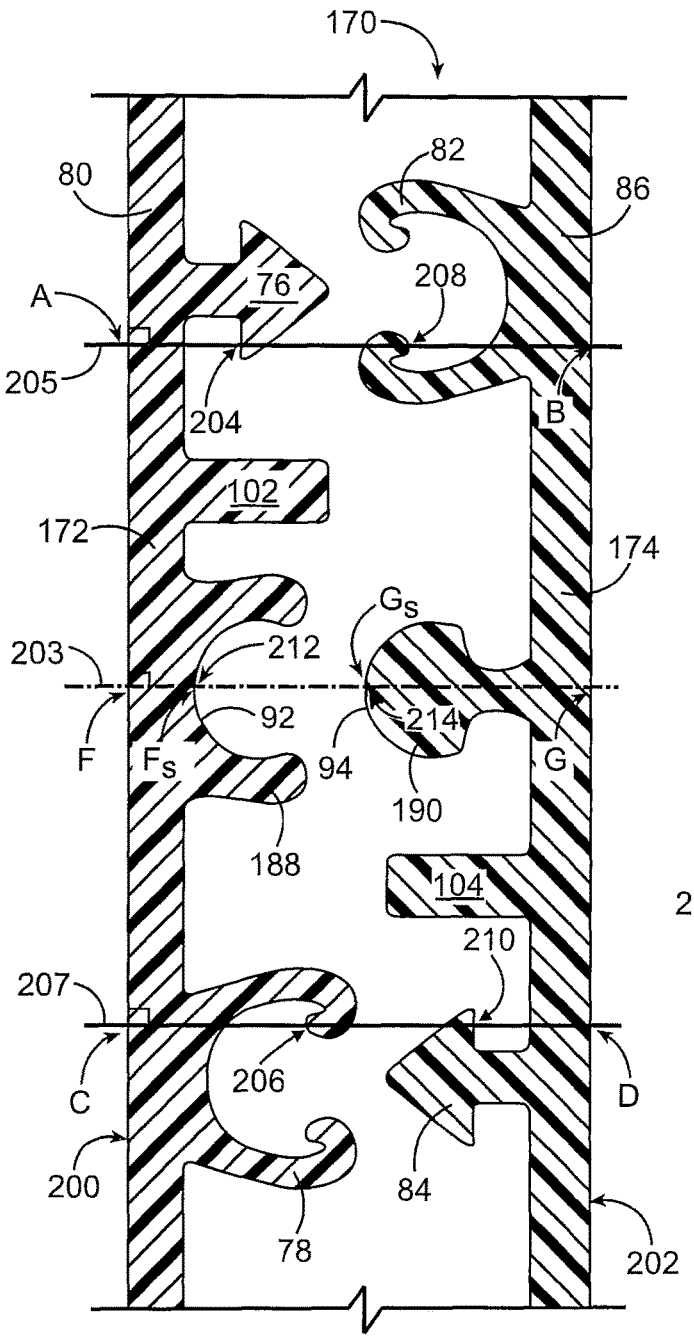
FIG. 3A is an enlarged partial cross-sectional view similar to the view of FIG. 2 of a resealable closure mechanism according to another embodiment.
Figure 3B:
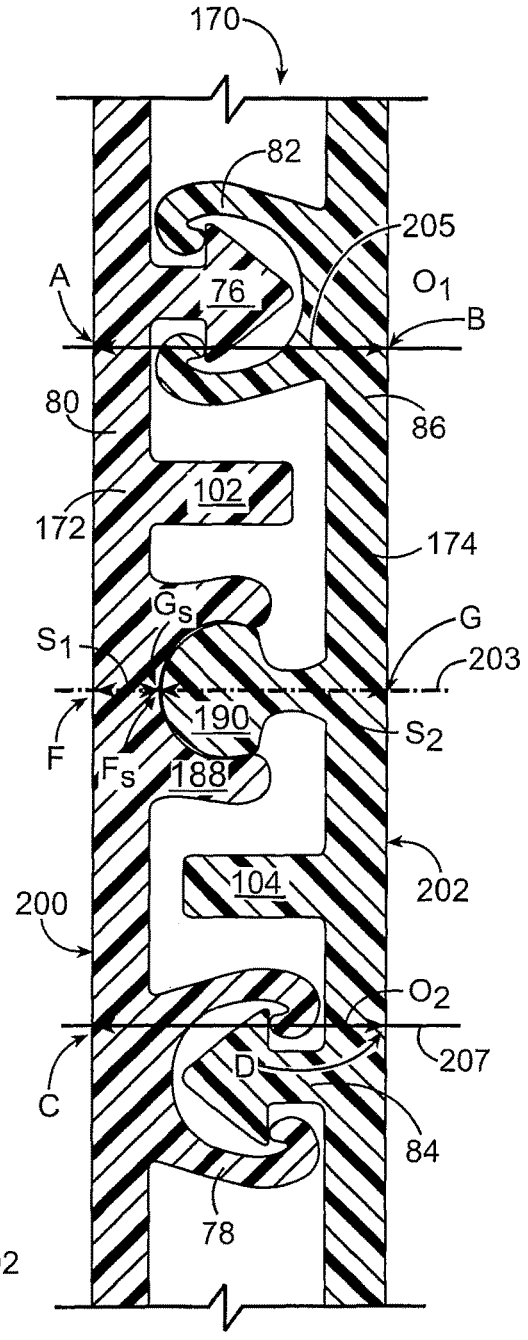
FIG. 3B is a partial cross-sectional view of the resealable closure mechanism of FIG. 3A shown in an occluded state.

Referring to FIGS. 3A and 3B, another embodiment of a resealable closure mechanism 170 is similar to the embodiment described with regard to FIG. 2 except that in this embodiment a first closure element 172 has a first sealing member 188 that includes the first sealing surface 92 in a groove, and a second closure element 174 has a second sealing member 190 that includes the second sealing surface 94 on a bulbous head that sealingly engages the groove of the first sealing member 188. As shown in FIG. 3A, a centerline 203 passes through the first and second sealing members 188, 190. A first datum line 200 is drawn perpendicular to the centerline 203 where the centerline 203 intersects an exterior surface of the first base 80. A second datum line 202 is drawn at a convenient location, which in this embodiment is coincident with an exterior surface of the second base 86. The first and second datum lines 200 and 202 may be aligned to be parallel when the first and second closure elements 172, 174 are unoccluded, as shown in FIG. 3A. However, because the first and/or second closure elements 172, 174 may flex when occluded, the first and second datum lines 200, 202 may become curvilinear and/or may not be parallel when the first and second closure elements are occluded, as shown in FIG. 3B. The first and second datum lines 200, 202 provide a basis for the discussion of distances to follow.

In an unoccluded state, a first contact surface 204 on the first interlocking profile 76 potentially engages a third contact surface 208 on the third interlocking profile 82. Similarly, a second contact surface 206 on the second interlocking profile 78 potentially engages a fourth contact surface 210 on the fourth interlocking profile 84. A line 205 that is parallel to the centerline 203 and that passes through the first and third contact surfaces 204, 208 intersects the first and second datum lines 200, 202 at reference points A and B, respectively. A line 207 that is parallel to the centerline 203 and that passes through the second and fourth contact surfaces 206, 210 intersects the first and second datum lines 200, 202 at reference points C and D, respectively.

The centerline 203 intersects the first and second datum lines 200, 202 at reference points F and G, respectively. Similarly, the centerline 203 intersects the first and second sealing surfaces 92, 94 at reference points $F_s$ and $G_s$, respectively. A first sealing distance, $S_1$, is measured between the reference points F and $F_s$, and a second sealing distance, $S_2$, is measured between the reference points G and $G_s$. A total sealing distance, S, is the sum of $S_1$ and $S_2$.

Illustratively, in an occluded state, as shown in FIG. 3B, regions of the first and second bases 80, 86 proximate to the first and third profiles 78, 82 generally cannot be further apart than when the first and third contact surfaces 204, 208 are engaged. Therefore, a first maximum occlusion distance, $O_1$, in the occluded state is measured between the reference points A and B. Similarly, regions of the first and second bases 80, 86 proximate to the second and fourth profiles 76, 84 generally cannot be further apart in the occluded state than when the second and fourth contact surfaces 206, 210 are engaged. Further, a second maximum occlusion distance, $O_2$, in the occluded state is measured between the reference points C and D. Each of the first and second sealing distances $S_1$ and $S_2$ may be a smaller distance when measured in an occluded state than when measured in an unoccluded state due to possible compression of the first and second sealing members 188, 190 upon occlusion of the first and second closure elements 172, 174. A gastight sealing engagement of the first and second sealing surfaces 92, 94 is facilitated when the total sealing distance, S, computed as the sum of the first and second sealing distances, $S_1$ and $S_2$, is greater than or at least about equal to the greater of $O_1$ and $O_2$.

FIG. 3B illustrates an embodiment of the resealable closure mechanism 170 where $O_1$ is about the same distance as $O_2$. However, the first, second, third, and fourth interlocking profiles 76, 78, 82, 84 may be sized such that $O_1$ is about the same distance as or a different distance than $O_2$. It is further contemplated that each of the distances $O_1$, $O_2$, and S, and/or a ratio of S to the larger of $O_1$ and $O_2$ may be adjusted prior to the manufacture of the first and second closure elements 72, 74. Such adjustment of the distances $O_1$, $O_2$, and S may have an effect on performance aspects of the resealable closure mechanism 170. For example, depending upon material flexibility, compressibility, or other factors as known to one skilled in the art, the ratio may be adjusted to tailor closing and opening forces of the closure elements 72, 74, as desired. The total sealing distance, S, may be adjusted by lengthening or shortening the first and/or second sealing distances $S_1$, $S_2$. An increase of the total sealing distance, S, without corresponding adjustment of the distances $O_1$ and $O_2$ may result in a closure mechanism with strong engagement between the first and second sealing surfaces 92, 94, but that is difficult for a user to occlude and/or deocclude. In contrast, a decrease of the ratio of S to the larger of $O_1$ and $O_2$ may result in a closure mechanism that is easier to occlude and deocclude but that has weak engagement of the first and second sealing surfaces 92, 94, which may not facilitate a gastight seal therebetween.

Each of the first and/or second maximum occlusion distances, $O_1$ and/or $O_2$, may be adjusted by lengthening, shortening, or changing the shape of any of the first, second, third, and fourth interlocking profiles 76, 78, 82, 84. For example, the distance $O_1$ may be adjusted prior to the manufacture of the first and second closure elements 72, 74 to be longer than the distance $O_2$. Such a configuration may facilitate easier opening of the closure mechanism 170 by a user while allowing the closure mechanism to maintain strong sealing engagement between the first and second sealing surfaces 92, 94. In contrast, adjustment of the distance $O_1$ to be shorter than the distance $O_2$ may facilitate more difficult opening of the closure mechanism 170 by a user.

Figure 4A:
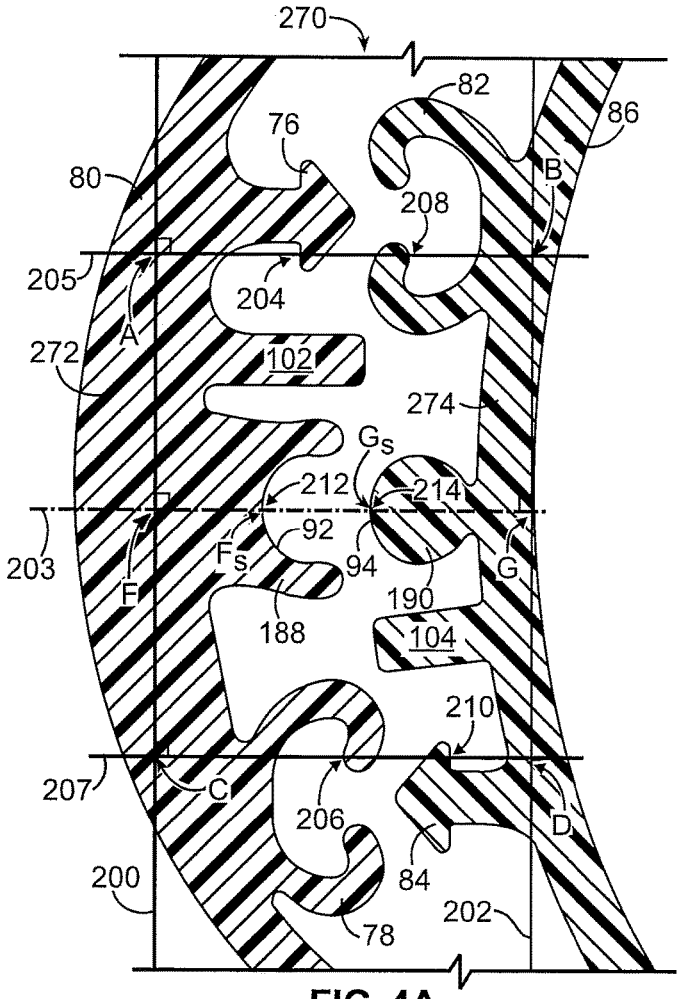
FIG. 4A is a partial cross-sectional view similar to the view of FIG. 2 of a resealable closure mechanism according to a further embodiment.
Figure 4B:
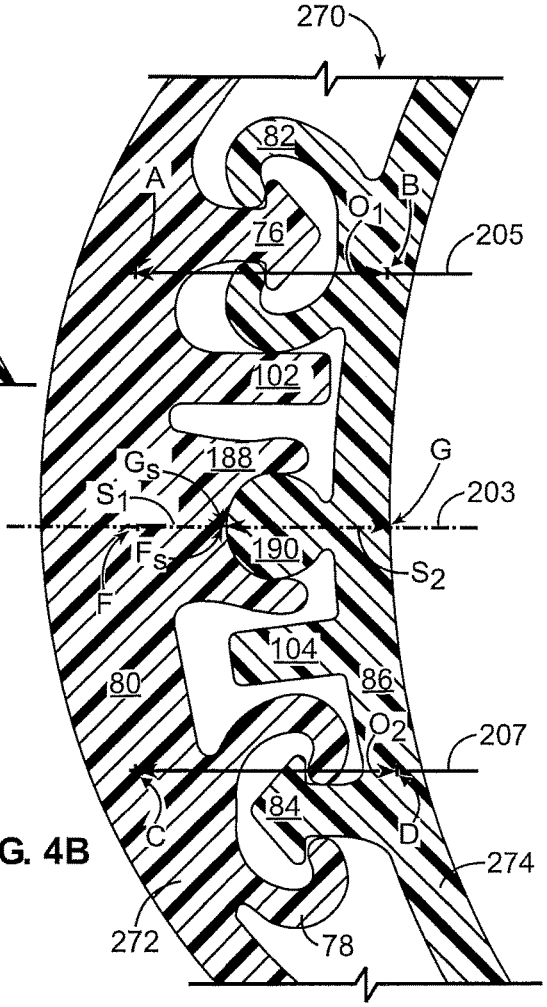
FIG. 4B is a partial cross-sectional view of the resealable closure mechanism of FIG. 4A shown in an occluded state.

In another embodiment shown in FIGS. 4A and 4B, the first and second bases 80 and 86 have curvilinear exterior surfaces. In FIG. 4A, the second datum line 202 is drawn perpendicular to the centerline 203 that passes through the first and second sealing members 188, 190, where the centerline 203 intersects with the exterior surface of the second base 86. The first datum line 200 is drawn parallel to the second datum line 202 at a convenient location, which in this embodiment is through the first base 80. The centerline 203 intersects with the first and second datum lines 200 and 202 at the respective reference points F and G, and the centerline 203 intersects the first and second sealing surfaces 92, 94 at the respective reference points $F_s$ and $G_s$. The first sealing distance, $S_1$, is a distance measured between the reference points F and $F_s$, and the second sealing distance, $S_2$, is a distance measured between the reference points G and $G_s$. The total sealing distance, S, is the sum of $S_1$ and $S_2$. The reference points A-D of this embodiment are determined following the same methodology as used for the embodiment described with regard to FIG. 3A hereinabove.

In an occluded state, as shown in FIG. 4B, the first maximum occlusion distance, $O_1$, is measured between the reference points A and B, and the second maximum occlusion distance, $O_2$, is measured between the reference points C and D. Due to possible flexibility of the first and second closure elements 272, 274, the reference points A, F, and C in FIG. 4B may not define a line. A gastight sealing engagement of the first and second sealing surfaces 92, 94 is facilitated when the total sealing distance, S, is greater than or at least about equal to the greater of $O_1$ and $O_2$.

Figure 5A:
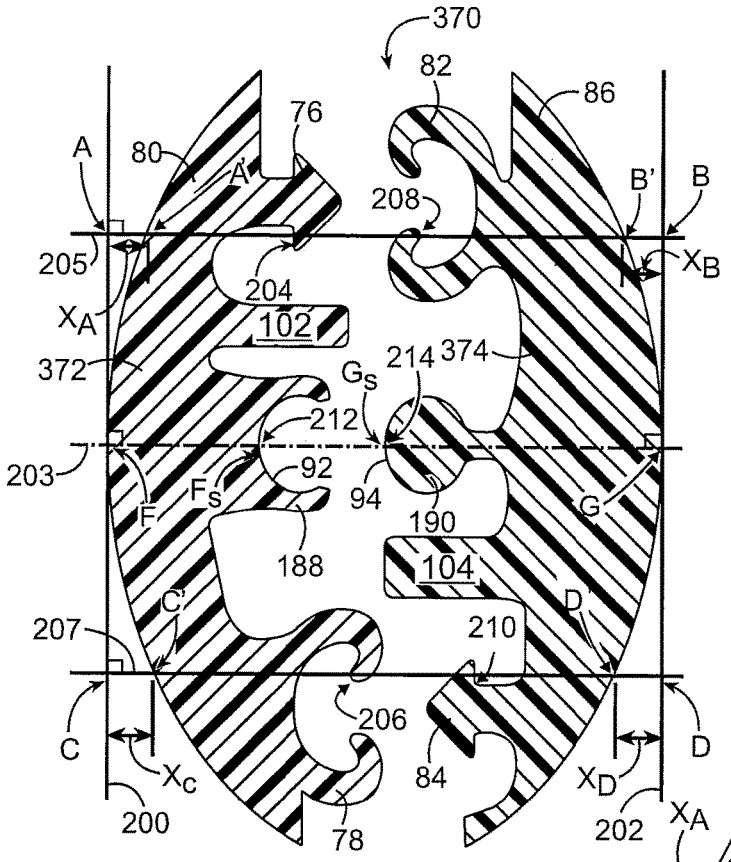
FIG. 5A is a cross-sectional view similar to the view of FIG. 2 of a resealable closure mechanism according to a still further embodiment.
Figure 5B:
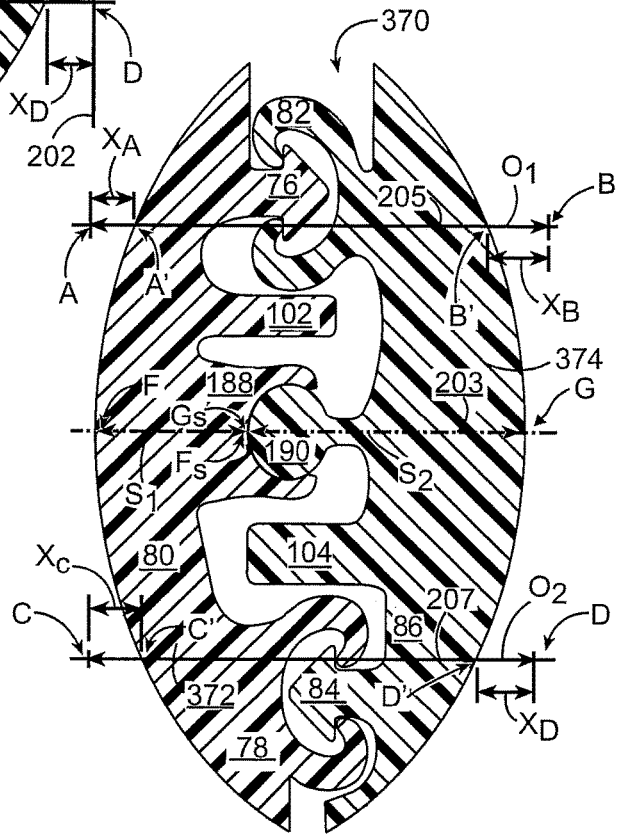
FIG. 5B is a cross-sectional view of the resealable closure mechanism of FIG. 5A shown in an occluded state.

The methodology used hereinabove for the determination of the reference points A-D, F, $F_s$, G, and $G_s$, and the resulting distances, $O_1$, $O_2$, $S_1$, $S_2$, and S that are measured with respect thereto may be applied to a closure mechanism having any base geometry. A resealable closure mechanism 370 is illustrated in FIGS. 5A and 5B that has first and second bases 80, 86, each with a convex exterior surface. In this embodiment, the first datum line 200 is drawn perpendicular to the centerline 203 that passes through the first and second sealing members 188, 190, where the centerline 203 intersects with the exterior surface of the first base 80. The second datum line 202 is drawn parallel to the first datum line 200 at a convenient location, which in this embodiment is where the centerline 203 intersects with the exterior surface of the second base 86. The centerline 203 intersects with the first and second datum lines 200 and 202 at the respective reference points F and G, and the centerline 203 intersects the first and second sealing surfaces 92, 94 at the respective reference points $F_s$ and $G_s$.

The reference points A-D, and the distances $S_1$, $S_2$, and S of this embodiment are determined following the same methodology as used for the embodiments described with regard to FIGS. 3A-4B hereinabove. However, as illustrated in FIG. 5A, in this embodiment, each of the reference points A-D lies outside of the closure mechanism 370. Therefore, each of the reference points A-D is further referenced to a point on the exterior surface of the first and second bases 80, 86. For example, the line 205 intersects the exterior surface of the first base 80, at a reference point A' that is determined to be a reference distance $X_A$ from the reference point A, and the line 205 intersects the exterior surface of the second base 86, at a reference point B' that is determined to be a reference distance $X_B$ from the reference point B. Similarly, the line 207 intersects the exterior surface of the first base 80, at a reference point C' that is determined to be a reference distance $X_C$ from the reference point C, and the line 207 intersects the exterior surface of the second base 86, at a reference point D' that is determined to be a reference distance $X_D$ from the reference point D.

In an occluded state, as shown in FIG. 5B, the first maximum occlusion distance, $O_1$, is a distance measured between the reference points A' and B', plus the reference distances $X_A$ and $X_B$. The second maximum occlusion distance, $O_2$, in the occluded state is a distance measured between the reference points C' and D', plus the reference distances $X_C$ and $X_D$. Due to possible flexibility of the first and second closure elements 372, 374, the reference points A, F, and C in FIG. 5B may not define a line. A gastight sealing engagement of the first and second sealing surfaces 92, 94 is facilitated when the total sealing distance, S, is greater than or at least about equal to the greater of $O_1$ and $O_2$.

Figure 6A:
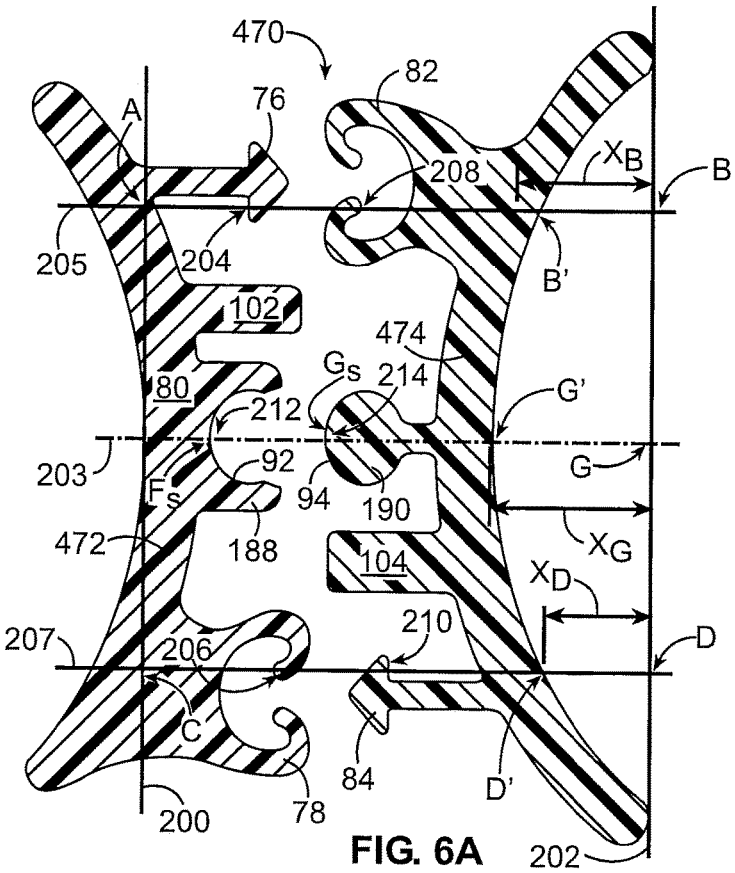
FIG. 6A is a cross-sectional view similar to the view of FIG. 2 of a resealable closure mechanism according to another embodiment.
Figure 6B:
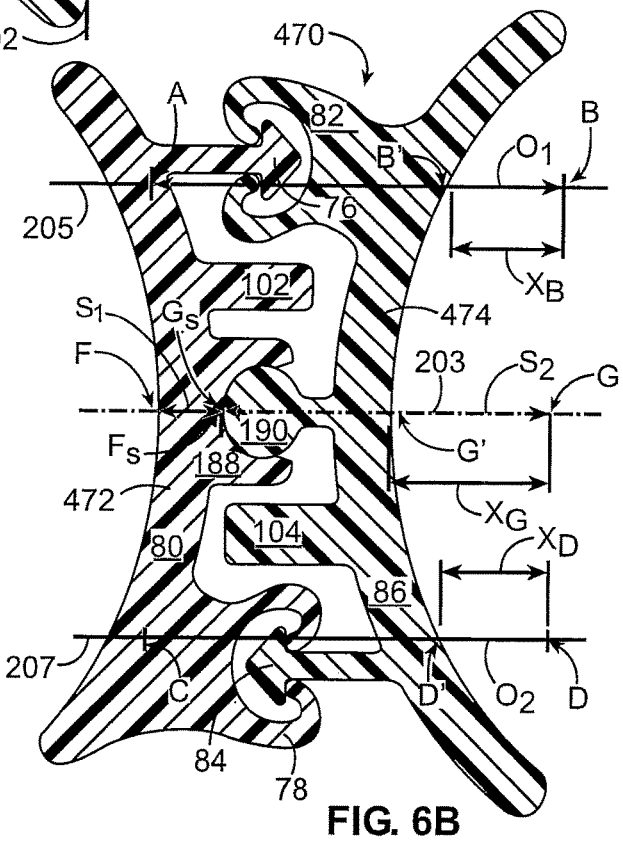
FIG. 6B is a cross-sectional view of the resealable closure mechanism of FIG. 6A shown in an occluded state.

A further embodiment of a resealable closure mechanism 470 is shown in FIGS. 6A and 6B. The first datum line 200 in this embodiment is drawn perpendicular to the centerline 203 and where the centerline 203 intersects the exterior surface of the first base 80. The second datum line 202 is drawn parallel to the first datum line 200 at a convenient location, which in this embodiment is tangent to the ends of the second base 86. The reference points A-D, F, $F_s$, G, and $G_s$ of this embodiment are determined following the same methodology as used for the embodiments described with regard to FIGS. 3A-5B hereinabove. Similar to the embodiment described with regard to FIG. 5A, the reference points B and D lie outside of the resealable closure mechanism 470 and the reference distances $X_B$ and $X_D$ are determined following the same methodology as used therein. In addition, the centerline 203 intersects the exterior surface of the base 86, at a reference point G' that is determined to be a reference distance $X_G$ from the reference point G.

In an occluded state, as shown in FIG. 6B, the first sealing distance, $S_1$, is a distance measured between the reference points F and $F_s$. The second sealing distance, $S_2$, is a distance measured between the reference points $G_s$ and G', plus the reference distance $X_G$. The total sealing distance, S, is the sum of the first and second sealing distances, $S_1$ and $S_2$. The first maximum occlusion distance, $O_1$, in the occluded state is a distance measured between the reference points A and B', plus the reference distance $X_B$. The second maximum occlusion distance, $O_2$, in the occluded state is a distance measured between the reference points C and D', plus the reference distance $X_D$. Due to possible flexibility of the first and second closure elements 472, 474, the reference points A, F, and C in FIG. 6B may not define a line. A gastight sealing engagement of the first and second sealing surfaces 92, 94 is facilitated when the total sealing distance, S, is greater than or at least about equal to the greater of $O_1$ and $O_2$.

Referring now to FIGS. 2-6, inner surfaces 96, 98 of the respective first and second sidewalls 52, 54 or a portion or area thereof, or portions of the first 72, 172, 272, 372, 472 and second 74, 174, 274, 374, 474 closure elements such as the sealing surfaces 92, 94 may, for example, be composed of a polyolefin plastomer such as an AFFINITY™ resin manufactured by Dow Plastics. One or more of the first and second sidewalls 52, 54 in other embodiments may also be formed of air-impermeable film. An example of an air-impermeable film includes a film having one or more barrier layers, such as an ethylene-vinyl alcohol copolymer (EVOH) ply or a nylon ply, disposed between or on one or more of the plies of the first and second sidewalls 52, 54. The barrier layer may be, for example, adhesively secured between PP and/or LDPE plies to provide a multilayer film. Other additives such as colorants, slip agents, and antioxidants, including for example talc, oleamide or hydroxyl hydrocinnamate may also be added as desired. In another embodiment, the resealable closure mechanism 70 may be extruded primarily of molten PE or LDPE with various amounts of slip component, colorant, and/or talc additives in a separate process. The fully formed resealable closure mechanism 70 may be attached to the pouch body, for example, using a strip of molten thermoplastic weld material, an adhesive, a direct weld, or otherwise as known by those skilled in the art. Other thermoplastic resins and air-impermeable films useful in the present disclosure include those disclosed in, for example, Tilman et al. U.S. Patent application publication No. 2006/0048483.

Figure 7A:
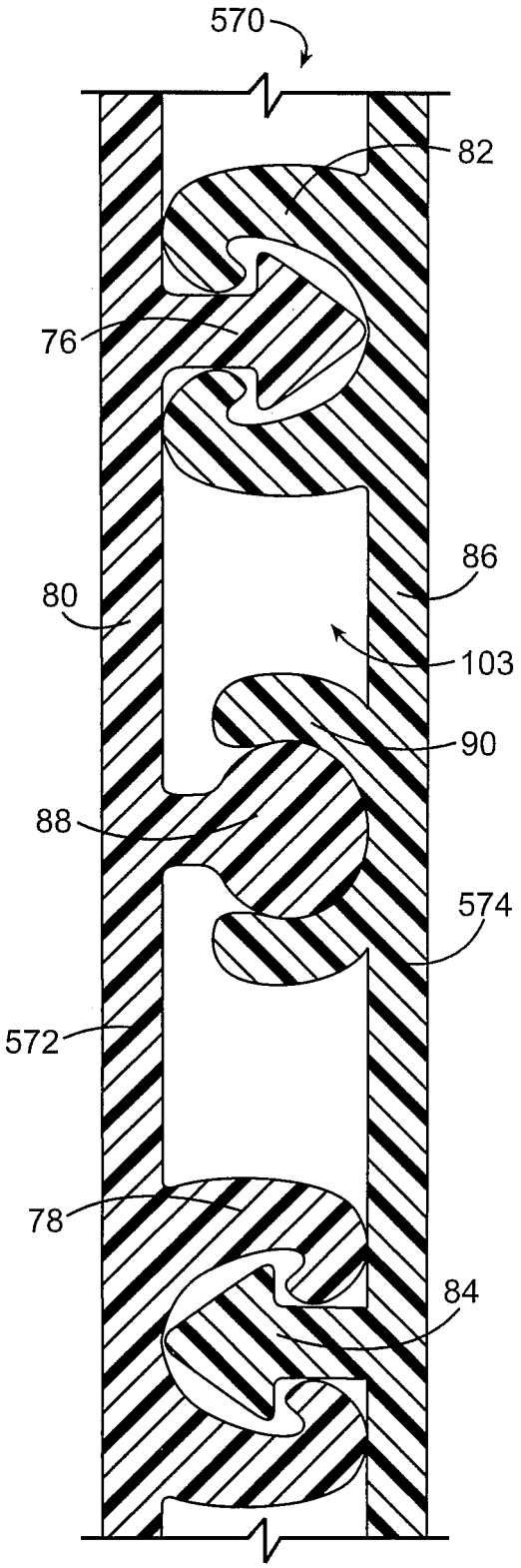
FIG. 7A is an enlarged partial cross-sectional view of a resealable closure mechanism similar to the resealable closure mechanism of FIG. 2, but lacking sealing reservoirs, with portions behind the plane of the cross-section omitted for clarity.
Figure 7B:
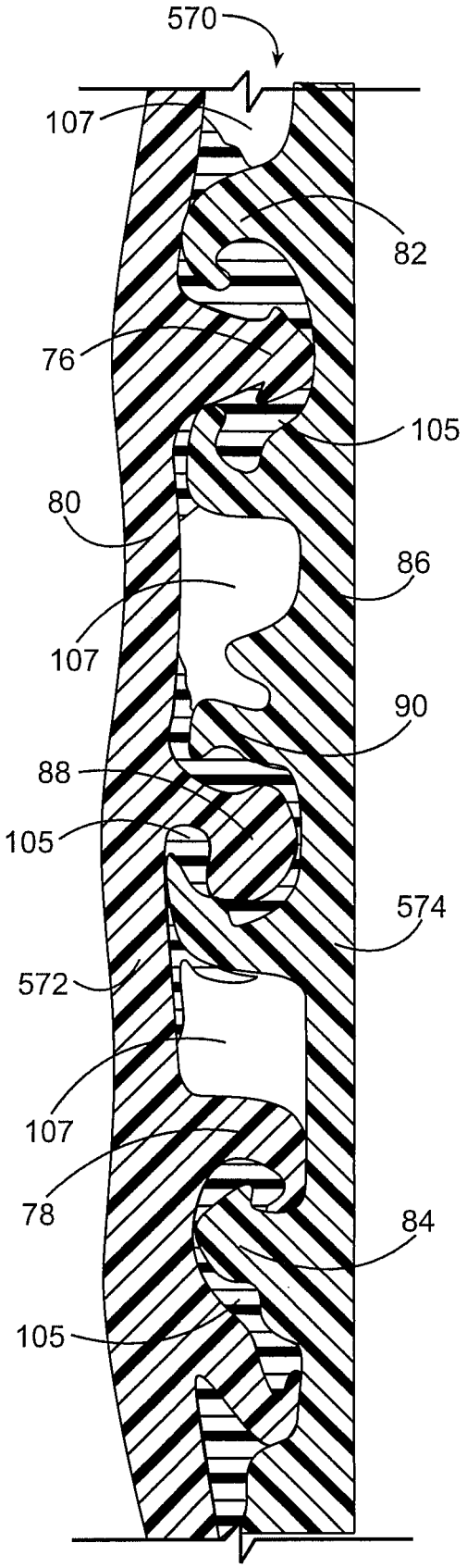
FIG. 7B is a partial cross-sectional view of the resealable closure mechanism of FIG. 7A, illustrating the state of the resealable closure mechanism subsequent to application of an end-stomp thereto, with portions behind the plane of the cross-section omitted for clarity.

Referring now to FIGS. 1 and 7A-7D, ends 100 (shown in FIG. 1) of the resealable closure mechanism 70 may be sealed by an end-stomp 101 at each of the peripheral edges 56 and 60. Each end-stomp 101 is defined by a region of the closure mechanism 70 where the first closure element 72 has been sealed to the second closure element 74 by, for example, crushing, ultrasonic vibration, and/or application of heat. Illustrative first and second closure elements 572, 574 are shown occluded in FIG. 7A at a point of closest engagement without deformation, and prior to application of an end-stomp thereto. In a completed end-stomp, as shown in FIG. 5B, 7B the first and second closure elements 72, 74 are crushed and/or heated and melted material 105 has spread between the first and second closure elements to form sealed regions therebetween.

However, in some instances, due to the bulk of the material within the first, second, third, and fourth interlocking profiles 76, 78, 84, and 86 and the first and second sealing members 88, 90 and the spacing between each, end-stomp application may result in incomplete sealing of the ends 100 due to gaps 107, as illustrated in FIG. 7B, that remain uncrushed and/or unfilled by the melted material 105 between the first and second closure elements 72, 74. Although the gaps 107 illustrated in the cross-sectional view of FIG. 7B, are not shown to be connected in the plane of the cross section, the gaps 107 may nevertheless connect to one another in other planes to provide a path for leakage (not shown) of gas into or out of the reclosable pouch 50. Although increased crushing or application of heat in the creation of the end-stomps 101 may shrink the gaps 107, the possibility of an interconnection between the gaps 107 and the formation of a path for leakage may still remain problematic.

Figure 6C:
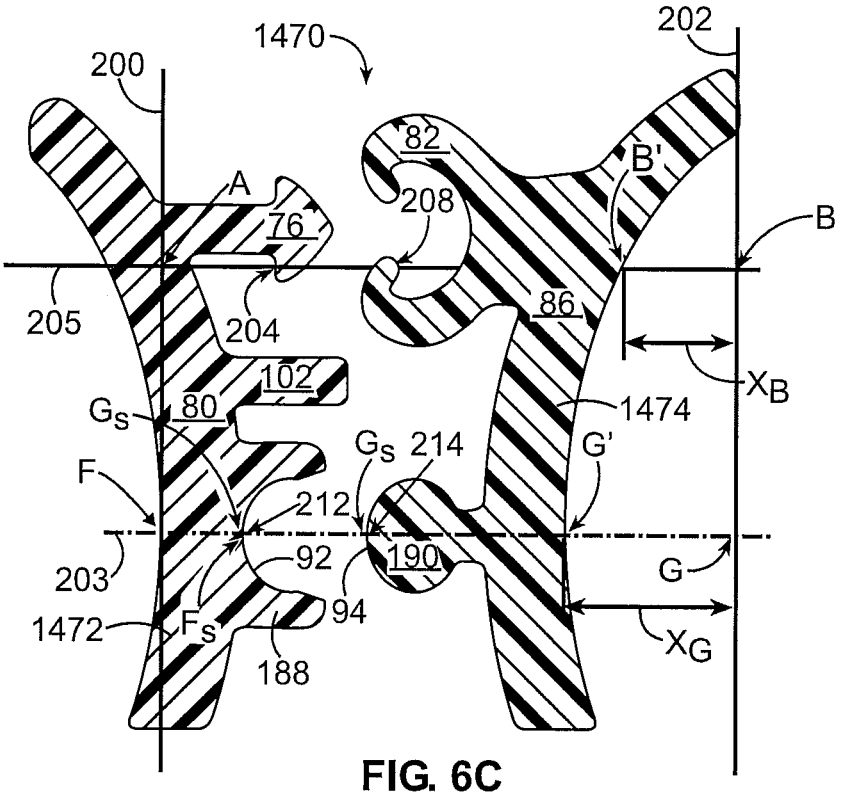
FIG. 6C is a cross-sectional view similar to the view of FIG. 2 of a resealable closure mechanism according to a further embodiment.
Figure 6D:
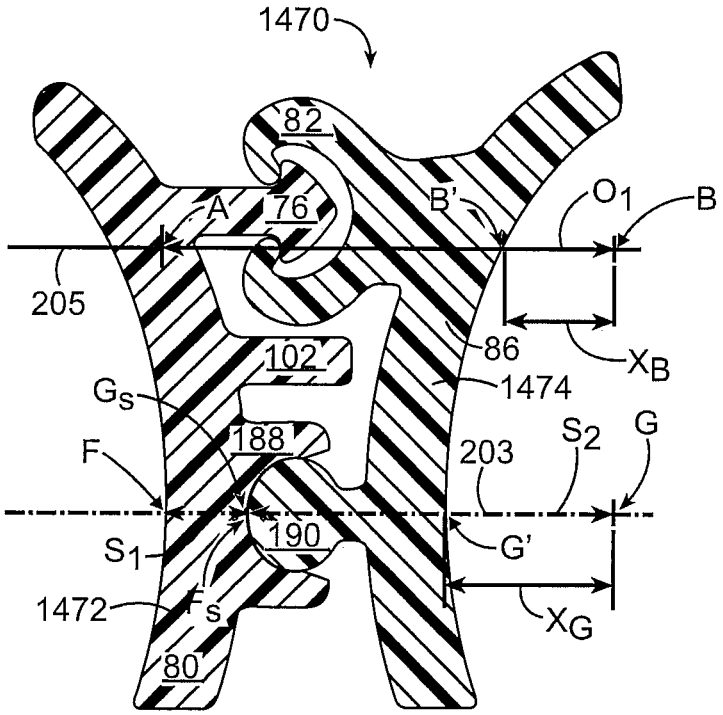
FIG. 6D is a cross-sectional view of the resealable closure mechanism of FIG. 6C shown in an occluded state.
Figure 6E:
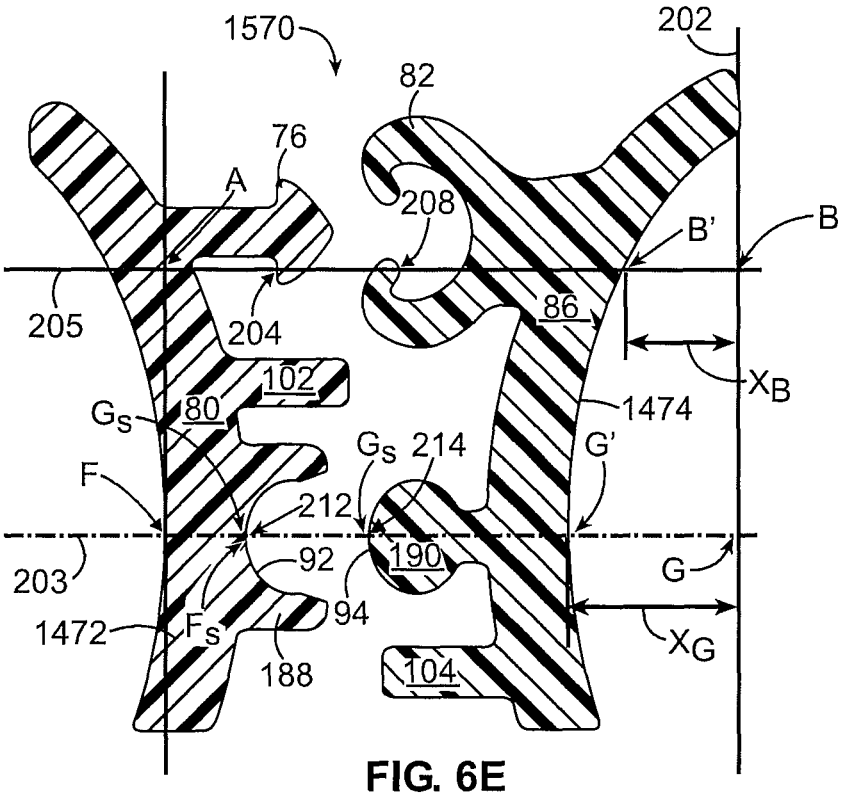
FIG. 6E is a cross-sectional view similar to the view of FIG. 2 of a resealable closure mechanism according to yet another embodiment.
Figure 6F:
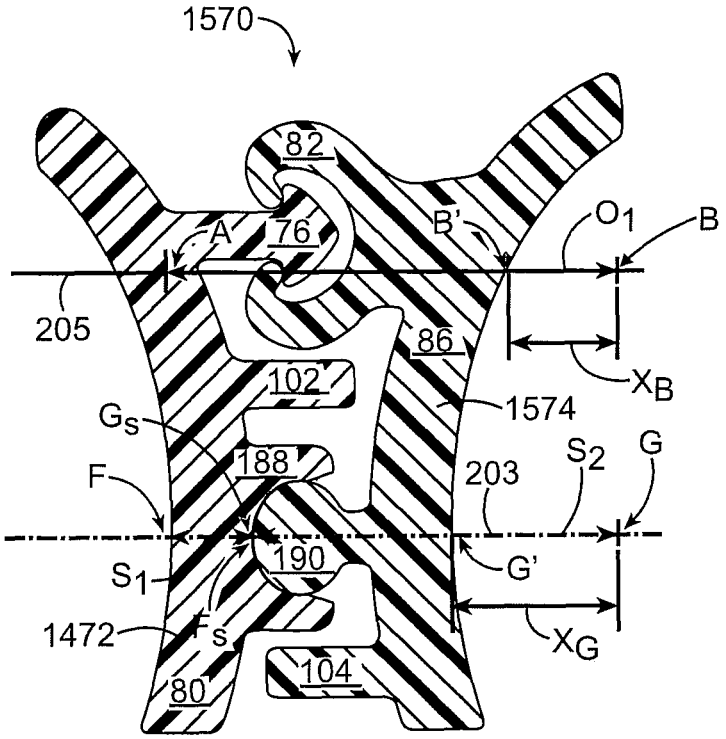
FIG. 6F is a cross-sectional view of the resealable closure mechanism of FIG. 6E shown in an occluded state.
Figure 7C:
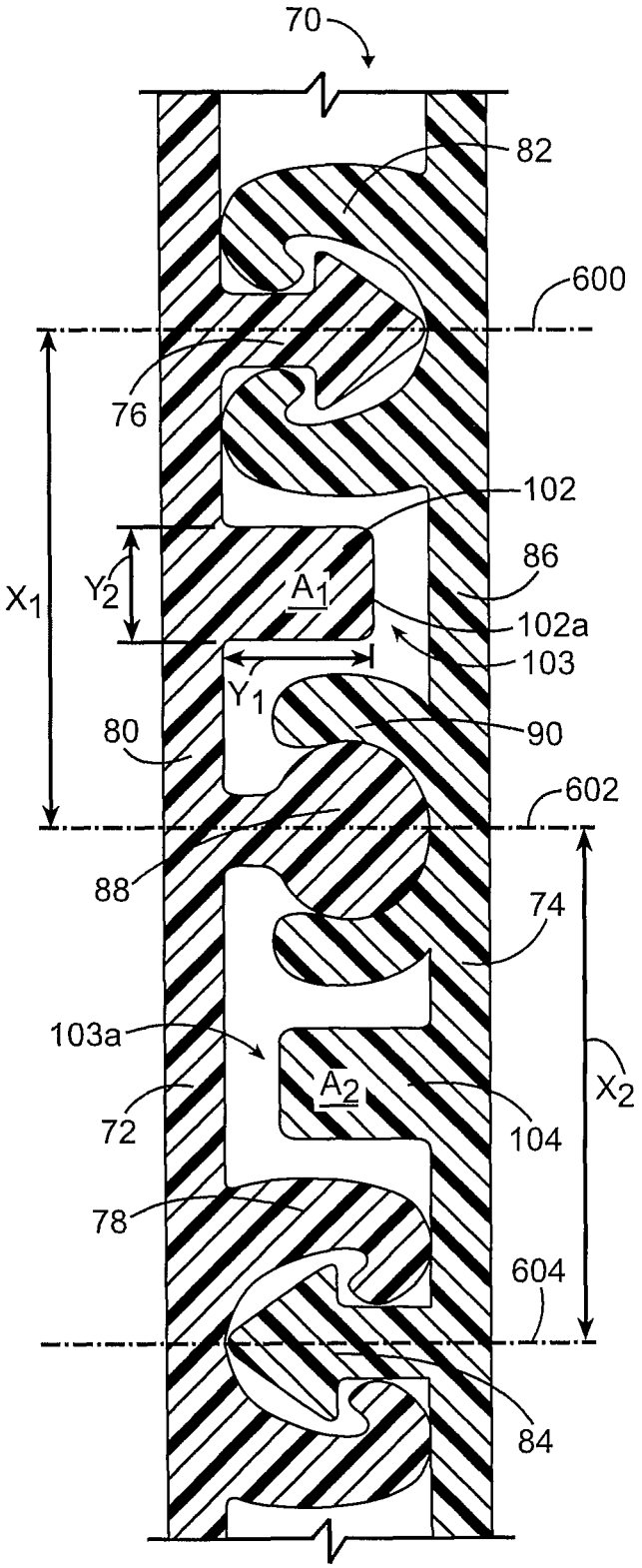
FIG. 7C is an enlarged partial cross-sectional view of the resealable closure mechanism of FIG. 2, with portions behind the plane of the cross-section omitted for clarity.
Figure 7D:
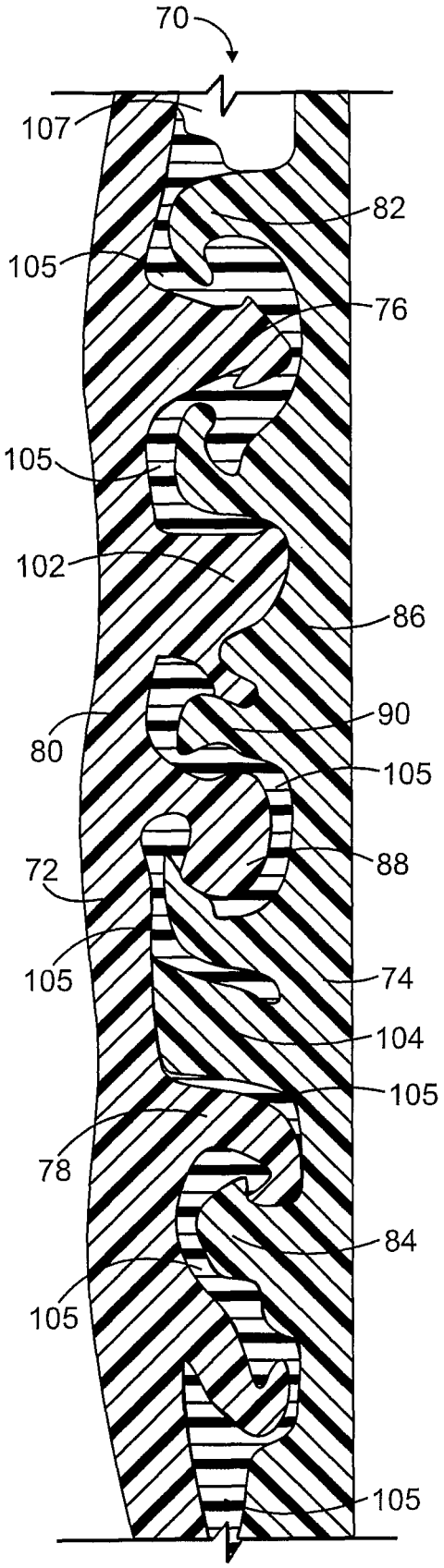
FIG. 7D is a partial cross-sectional view of the resealable closure mechanism of FIG. 7C, illustrating the state of the resealable closure mechanism subsequent to application of an end-stomp thereto, with portions behind the plane of the cross-section omitted for clarity.

To facilitate elimination of leakage paths in the end-stomps 101 and possibly allow for less heating and/or crushing force and thus reduce manufacturing costs and/or time, first and second sealing reservoir protrusions 102, 104 are provided, as illustrated in FIGS. 2-6, 7C, 7D, and 8-10. Referring to FIG. 7C, the resealable closure mechanism 70 is illustrated. The first sealing reservoir protrusion 102 is provided, for example, depending from the first base 80 and disposed between the first interlocking profile 76 and the first sealing member 88. The second sealing reservoir protrusion 104 is provided, for example, depending from the second base 86 and disposed between the fourth interlocking profile 84 and the second sealing member 90. Referring to FIG. 7D, the uncrushed gaps 107 are illustrated as having been eliminated due to the presence of the sealing reservoirs 102, 104 on the first and second closure elements 72, 74.

Each of the first and second sealing reservoir protrusions 102, 104 may be made of a material that is the same as or different from the rest of the first and second closure elements 72, 74. For example, each of the first and second sealing reservoir protrusions 102, 104 may be made of a material that has a lower melting temperature than the rest of the first and second closure elements 72, 74. A lower melting temperature for the sealing reservoir protrusions 102, 104 may further facilitate filling of the gaps 107 that may remain uncrushed between the first and second closure elements 72, 74 and may further allow for less crushing force to be applied to the first and second closure elements 72, 74.

Referring to FIG. 7C, a first occluded space 103 is illustratively defined between the third interlocking profile 82 and the second sealing member 90. Similarly, a second occluded space 103*a* is illustratively defined between the second interlocking profile 78 and the second sealing member 90. Areas of the first and second occluded spaces 103 and 103*a* may be a function of the sizes and/or shapes of the interlocking profiles 78, 78, 82, 84, and/or the sealing members 88, 90, as defined by the distances $O_1$, $O_2$, and S, described hereinabove. Areas of the first and second occluded spaces 103 and 103*a* may also be a function of the separation between the engaging pairs of interlocking profiles and sealing members. For example, a first separation distance $X_1$ is a perpendicular distance between a first centerline 600 drawn through the first and third interlocking profiles 76, 82 and a second centerline 602 drawn through the first and second sealing members 88, 90. Similarly, a second separation distance $X_2$ is a perpendicular distance between a third centerline 604 drawn through the second and fourth interlocking profiles 78, 84 and the second centerline 602. The first and second separation distances $X_1$ and $X_2$, may have same or different values. In one embodiment, the first separation distance $X_1$ is in a range from about 0.05 to about 0.12 inches (about 1.27 to about 3.05 mm). In another embodiment, the first separation distance is in a range from about 0.07 to about 0.10 inches (about 1.78 to about 2.54 mm). In yet another embodiment, the first separation distance is in a range from about 0.08 to about 0.09 inches (about 2.03 to about 2.29 mm).

The first sealing reservoir 102 may be sized and shaped, for example, to have a material volume that is sufficient to form a seal between the first and second closure elements 72, 74 within the first occluded space 103, and the second sealing reservoir 104 may be sized and shaped, for example, to have a material volume that is sufficient to form a seal between the first and second closure elements 72, 74 within the second occluded space 103*a*. An increase in the first or second separation distances $X_1$ or $X_2$ may necessitate a larger respective first or second sealing reservoir 102, 104 to achieve an equivalent sealing effect. Conversely, a decrease in the first or second separation distances $X_1$ or $X_2$ may allow for a smaller respective first or second sealing reservoir 102, 104 to achieve an equivalent sealing effect. If at least one of the first and second sealing reservoirs 102, 104 contains enough material to form a seal between the first and second closure elements 72, 74 within the respective first or second occluded spaces 103, 103*a*, then the uncrushed gaps 107 may be sufficiently alleviated to prevent the formation of a path for leakage of gas into or out of the pouch 50.

Referring again to FIG. 7C, dimensions of each of the first and second sealing reservoirs 102, 104 may be constrained by factors such as ease of use of the closure mechanism or ease of manufacture of the closure mechanism. In this respect, for example, the first sealing reservoir 102 may be manufactured to have a first dimension, Y.sub.1, that transversely extends from the first base 80 to a pre-determined distance as desired, as long as a distal end 102*a* of the first sealing reservoir does not interfere with occlusion of the first and third interlocking profiles 76, 82 by contacting the second base 86 before the first and third interlocking profiles can occlude. The first sealing reservoir 102 may also be limited in a second dimension, Y.sub.2, parallel to the first base 80. This dimensional constraint arises because, upon extrusion from a die, the first sealing reservoir may fuse to an adjacent profile or sealing member, for example, the first interlocking profile 76 or the first sealing member 88, if a sufficient spacing does not exist therebetween.

The first sealing reservoir 102 may have a first cross-sectional area, $A_1$, and the second sealing reservoir 104 may have a second cross-sectional area, $A_2$. The first and second cross-sectional areas $A_1$ and $A_2$ may have an equivalent value or a different value, because each respective first and second sealing reservoir may have a cross-sectional area tailored to be used in a different sized occluded space. In one embodiment, the first cross-sectional area $A_1$ of the first sealing reservoir is in a range from about 0.00014 to about 0.00080 inches$^2$ (about 0.09 to about 0.52 mm$^2$). In another embodiment, the first cross-sectional area $A_1$ of the first sealing reservoir is in a range from about 0.00027 to about 0.00055 inches$^2$ (about 0.17 to about 0.35 mm$^2$). In yet another embodiment, the first cross-sectional area $A_1$ of the first sealing reservoir is in a range from about 0.00035 to about 0.00045 inches$^2$ (about 0.23 to about 0.29 mm$^2$). Regardless of the size, shape, or material used, the sealing reservoir protrusions 102, 104 may each be independently added to the rest of the respective first and second closure elements 72, 74, for example, by independent extrusion thereon, or may be integral with the rest of the respective first and second closure elements 72, 74, for example, by coextrusion therewith.

Again referring to FIG. 2, in this embodiment, a first flange 106 longitudinally extends from an opening end of the first base 80 beyond the first interlocking profile 76. A second flange 108 longitudinally extends from an interior end of the first base 80 beyond the second interlocking profile 78. Similarly, a third flange 110 longitudinally extends from an opening end of the second base 86 beyond the third interlocking profile 82 and a fourth flange 112 longitudinally extends from an interior end of the second base 86 beyond the fourth interlocking profile 84. In other embodiments not shown, each of the first and second closure elements 72, 74 may not have flanges or may have only a single flange. In this embodiment, the inner surface 96 of the first sidewall 52 is attached to the first flange 106 and the inner surface 98 of the second sidewall 54 is attached to the third and fourth flanges 110, 112. The second flange 108 remains unattached to the first sidewall 52, as shown in FIG. 2 to allow the first sidewall 52 to bow outwardly under the influence of increased gas pressure in the interior 62 of the pouch 50. This outward bowing may relieve any tendency for the first and second closure elements 72, 74 to be forced apart in response to increased gas pressure in the pouch interior 62. Each of the first, third, and fourth flanges 106, 110, and 112 may be attached to the corresponding first or second sidewall 52, 54, for example, by a direct weld as shown in FIG. 2, or by an adhesive, a thermoplastic weld layer, or otherwise as known to a person having skill in the art.

Figure 8:
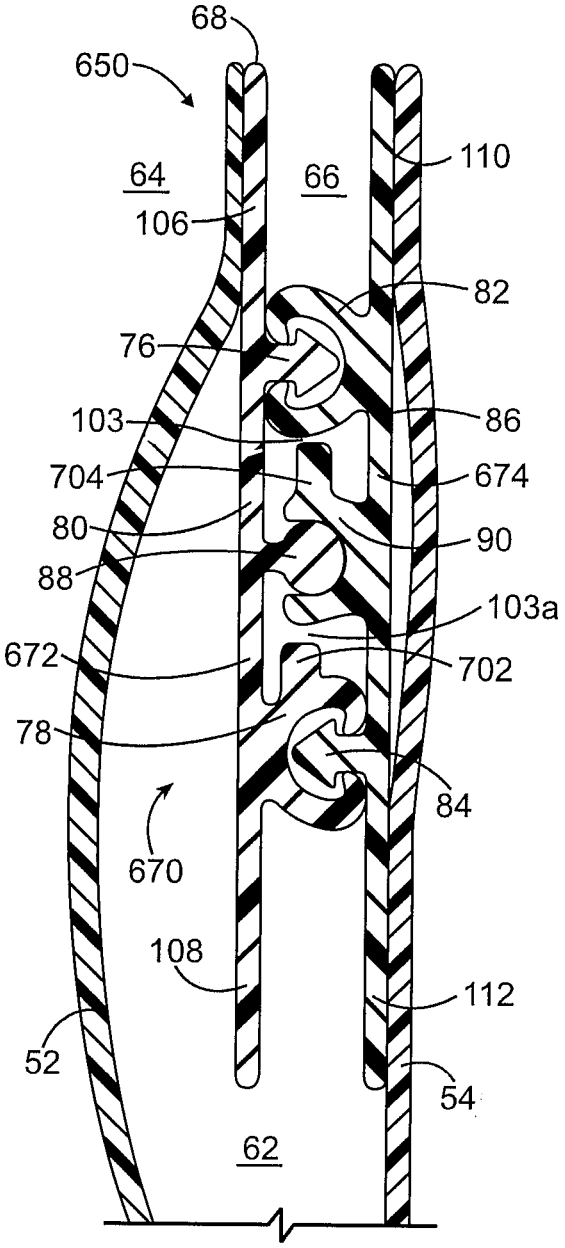
FIG. 8 is a partial cross-sectional view similar to the view of FIG. 2 of a flexible pouch and resealable closure mechanism according to another embodiment.

Another embodiment of a resealable closure mechanism 670 disposed on a reclosable pouch 650 is illustrated in FIG. 8. This embodiment is similar to the embodiment described with regard to FIG. 2, except for the following differences. In this embodiment, a first closure element 672 includes a first sealing reservoir protrusion 702, for example, depending from the second interlocking profile 78 and extending toward the first sealing member 88. A second closure element 674 includes a second sealing reservoir protrusion 704, for example, depending from the second sealing member 90 and extending toward the third interlocking profile 82. Each of the first and second sealing reservoir protrusions 702, 704 provides, for example, a material volume that is sufficient to form a seal between the first and second closure elements 672, 674 within the respective first and second occluded spaces 103, 103*a* when the end-stomps 101 are formed at the ends 100 of the resealable closure mechanism 670. Further, each of the first and second sealing reservoir protrusions 702, 704 may depend from the first closure element to form a seal within the first and second occluded spaces 103, 103*a* or may depend from the second closure element to form a seal within the first and second occluded spaces 103, 103*a*.

Figure 9:
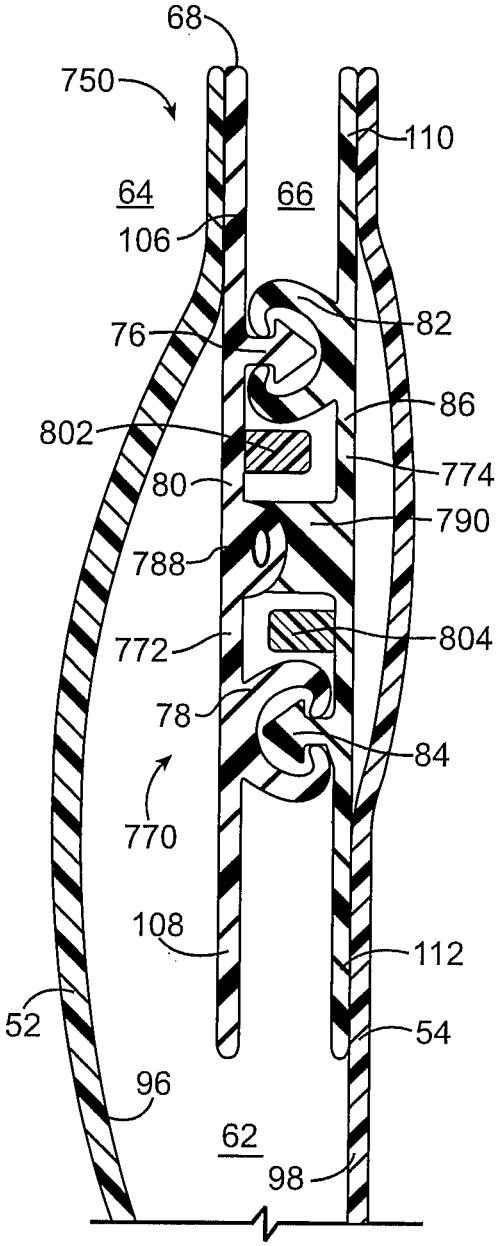
FIG. 9 is a partial cross-sectional view similar to the view of FIG. 2 of a flexible pouch and resealable closure mechanism according to still another embodiment.

A further embodiment of a resealable closure mechanism 770 disposed on a reclosable pouch 750 is illustrated in FIG. 9. This embodiment is similar to the embodiment described with regard to FIG. 2, except for the following differences. In this embodiment, a first closure element 772 includes, for example, a compressible first sealing member 788 that may have a hollow cross-section as illustrated. A second closure element 774 includes, for example, a second sealing member 790 that has a shape that is complementary to the first sealing member 788. Either or both of the first and second sealing members 788, 790 may be made from a material that is more compressible than the rest of the respective first and second closure elements 772, 774.

A first sealing reservoir protrusion 802, for example, depends from the first base 80 and is disposed between the first interlocking profile 76 and the first sealing member 788. The first sealing reservoir protrusion 802 is composed of a material that has a lower melting temperature than the rest of the first closure element 772. A second sealing reservoir protrusion 804, for example, depends from the second base 86 and is disposed between the fourth interlocking profile 84 and the second sealing member 790. The second sealing reservoir protrusion 804 is composed of a material that has a lower melting temperature than the rest of the second closure element 774.

Figure 10:
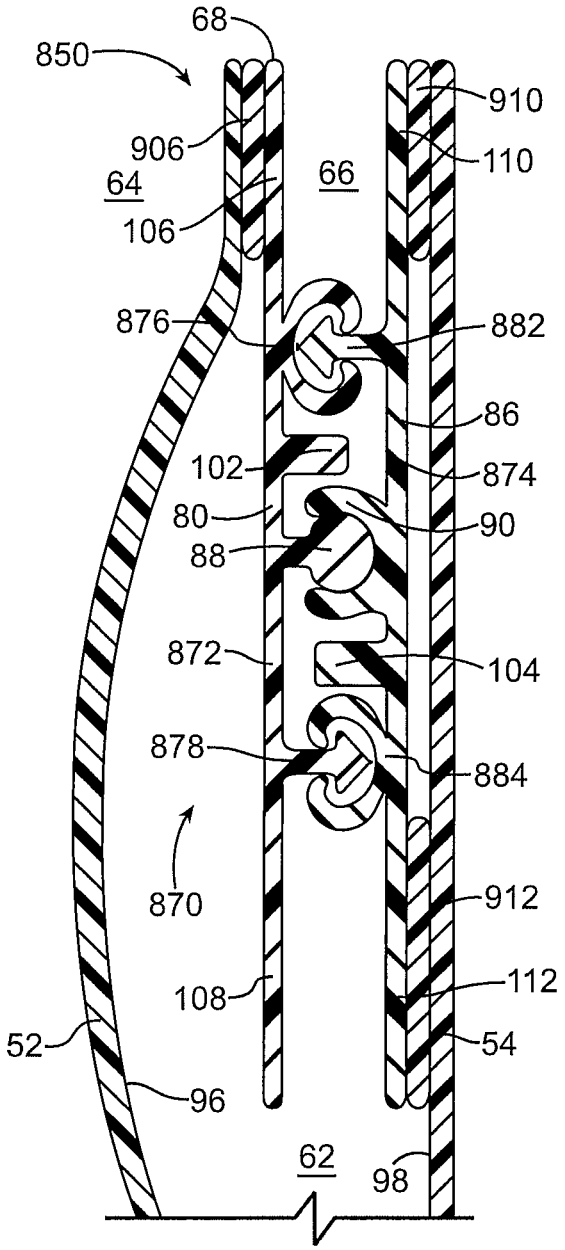
FIG. 10 is a partial cross-sectional view similar to the view of FIG. 2 of a flexible pouch and resealable closure mechanism of yet another embodiment.

Another embodiment of a resealable closure mechanism 870 disposed on a reclosable pouch 850 is illustrated in FIG. 10. This embodiment is similar to the embodiment described with regard to FIG. 2, except for the following differences. In this embodiment, a first closure element 872 includes, for example, a first interlocking profile 876 that is a female profile and a second interlocking profile 878 that is a male profile. A second closure element 874 includes, for example, a third interlocking profile 882 that is a male profile and a fourth interlocking profile 884 that is a female profile. Further, the first flange 106 is attached to the first sidewall 52 by a first thermoplastic weld layer 906, the third flange 110 is attached to the second sidewall 54 by a second thermoplastic weld layer 910, and the fourth flange 112 is attached to the second sidewall 54 by a third thermoplastic weld layer 912.

A further embodiment of a resealable closure mechanism 1470 is shown in FIGS. 6C and 6D. This embodiment is similar to the embodiment described with regard to FIGS. 6A and 6B, except for the following differences. A first closure element 1472 lacks the second interlocking profile 78, and a second closure element 1474 lacks the fourth interlocking profile 84 and the second sealing reservoir protrusion 104. As exemplified hereinabove, the determination of the distances $O_1$, $S_1$, $S_2$, and S begins with establishment of the centerline 203 that passes through the first and second sealing members 188, 190. Subsequently, the reference points A, B, B', F, $F_s$, G, G', and $G_s$ of this embodiment are determined following the same methodology as used for the embodiment described with regard to FIGS. 6A and 6B hereinabove. Due to possible flexibility of the first and second closure elements 1472, 1474, a line segment drawn between the reference points A and F in FIG. 6D may not be perpendicular to the centerline 203. A gastight sealing engagement of the first and second sealing surfaces 92, 94 is facilitated when the sum of the first and second sealing distances, $S_1$ and $S_2$, is greater than or at least about equal to $O_1$.

Another embodiment of a resealable closure mechanism 1570, shown in FIGS. 6E and 6F is substantially similar to the embodiment described with regard to FIGS. 6C and 6D, except that a second closure element 1574 includes the second sealing reservoir protrusion 104. The determination of the distances $O_1$, $S_1$, $S_2$, and S, and the reference points A, B, B', F, $F_s$, G, G', and $G_s$ of this embodiment are determined following the same methodology as used for the embodiments described with regard to FIGS. 6A-6D hereinabove. It is contemplated that the second sealing reservoir protrusion 104 may facilitate elimination of leakage paths in the end-stomps 101 as described hereinabove. It is further contemplated that the second sealing reservoir protrusion may optionally be disposed (not shown) proximate to the second sealing member 190 to contact and apply a force to the first sealing member 188 that may further facilitate a gastight seal between the first and second sealing members 188, 190 when the first and second closure elements 1472, 1574 are occluded. In one embodiment, the resealable closure mechanisms 1470 and 1570 may each be applied to a pouch oriented such that the first and third interlocking profiles 76, 82 are on an exterior side thereof. In another embodiment, the resealable closure mechanisms 1470 and 1570 may each be applied to a pouch oriented such that the first and third interlocking profiles 76, 82 are on an interior side thereof.

In the manufacture of a reclosable pouch described herein, for example, in the embodiment of the reclosable pouch 50 shown in FIG. 1, the first and second sidewalls 52, 54 may be extruded as a single flat sheet that is folded over onto itself to form the bottom peripheral edge 58 for the reclosable pouch 50. The first and second closure elements, for example, 72 and 74 may each be extruded as a tape, independently from the first and second sidewalls 52, 54. The first and second bases 80, 86 may be sealed to the interior surfaces 96, 98 of the respective first and second sidewalls 52, 54 by a direct weld or application of a thermoplastic weld layer, or by some other method as may be known to a person of skill in the art. The reclosable pouch 50 described herein can be made by various techniques known to those skilled in the art including those described in, for example, Geiger et al., U.S. Pat. No. 4,755,248. Other useful techniques to make a reclosable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a reclosable pouch as described herein include, for example, a cast post applied process, a cast integral process, and/or a blown process.

Although various specific embodiments have been shown and described herein, this specification explicitly includes all possible permutations of combinations of the features, structures, and components of all the embodiments shown and described.

INDUSTRIAL APPLICABILITY

A leak-proof or gastight resealable closure mechanism for a reclosable pouch is presented that may be used to pack and store items contained therein in a vacuum environment. The closure mechanism includes a sealing section that is spacedly disposed from an interlocking section and a sealing reservoir protrusion that provides extra material that may be crushed and/or melted to provide a more secure gastight seal at ends of the closure mechanism.

Numerous modifications to the present disclosure will be apparent to those skilled in the art in view of the foregoing description. Accordingly, this description is to be construed as illustrative only and is presented for the purpose of enabling those skilled in the art to make and use the disclosure and to teach the best mode of carrying out same. The exclusive rights to all modifications which come within the scope of the appended claims are reserved. All patents, patent publications and applications, and other references cited herein are incorporated by reference herein in their entirety.

We claim:

1. A reclosable vacuum-tight pouch comprising:

(A) a first sidewall and a second sidewall joined together to define an interior and an opening of the pouch; and (B) a closure mechanism attached to the first sidewall and the second sidewall along the opening of the pouch from a first end of the closure mechanism to a second end of the closure mechanism, the closure mechanism consisting of:

(i) a first base having an opening end and an interior end, the first base being attached to the first sidewall from the first end to the second end of the closure mechanism;

(ii) a first interlocking profile extending from the first base;

(iii) a first flange extending along a length of the first base from the first interlocking profile to the opening end of the first base, the first flange being attached to the first sidewall of the pouch at the opening end of the first base, from the first end to the second end of the closure mechanism;

(iv) a second interlocking profile extending from the first base;

(v) a second flange extending along a length of the first base from the second interlocking profile to the interior end of the first base, the second flange being unattached to the first sidewall of the pouch at the interior end of the first base, from the first end to the second end of the closure mechanism;

(vi) a first sealing member extending from the first base, the first sealing member being positioned between and spaced from the first and second interlocking profiles, such that the first sealing member is spaced from the first interlocking profile by a first separation distance to create a space between the first sealing member and the first interlocking profile, the first sealing member comprising an extended region that extends from the first base and a protruding end comprising a bulbous head with a protruding end sealing surface disposed along the majority thereof;

(vii) a second base having an opening end and an interior end, the second base being attached to the second sidewall from the first end to the second end of the closure mechanism;

(viii) a third interlocking profile extending from the second base, the third interlocking profile being configured to occlude and to deocclude with the first interlocking profile;

(ix) a third flange extending along a length of the second base from the third interlocking profile to the opening end of the second base, the third flange being attached to the second sidewall of the pouch at the opening end of the second base, from the first end to the second end of the closure mechanism;

(x) a fourth interlocking profile extending from the second base, the fourth interlocking profile being configured to occlude and to deocclude with the second interlocking profile;

(xi) a fourth flange extending along a length of the second base from the fourth interlocking profile to the interior end of the second base, the fourth flange being attached to the second sidewall of the pouch at the interior end of the second base, from the first end to the second end of the closure mechanism;

(xii) a second sealing member extending from the second base, the second sealing member being positioned between and spaced from the third and fourth interlocking profiles, such that the second sealing member is spaced from the fourth interlocking profile by a second separation distance to create a space between the second sealing member and the fourth interlocking profile, the second sealing member comprising a grooved member that has a grooved member sealing surface disposed thereon, such that the grooved member sealing surface is complementary to and sealingly engages the protruding end sealing surface, by surrounding at least a majority of the protruding end sealing surface and forming a gastight seal therebetween;

(xiii) a first sealing reservoir protrusion extending from the first base, the first sealing reservoir protrusion being positioned in the space between the first sealing member and the first interlocking profile, such that the first sealing reservoir protrusion is spaced from the first and second sealing members, the first interlocking profile, and the second base, and the first sealing reservoir protrusion being of a size and a shape to form a seal within the space between the first sealing member and the first interlocking profile, the size and shape of the first sealing reservoir protrusion relating to the first separation distance of the first sealing member from the first interlocking profile;

(xiv) a second sealing reservoir protrusion extending from the second base, the second sealing reservoir protrusion being positioned in the space between the second sealing member and the fourth interlocking profile, such that the second sealing reservoir protrusion is spaced from the first and second sealing members, the fourth interlocking profile, and the first base, and the second sealing reservoir protrusion being of a size and a shape to form a seal within the space between the second sealing member and the fourth interlocking profile, the size and shape of the second sealing reservoir protrusion relating to the second separation distance of the second sealing member from the fourth interlocking profile;

(xv) a first end-stomp positioned at the first end of the closure mechanism; and (xvi) a second end-stomp positioned at the second end of the closure mechanism, wherein the first and second sealing reservoir protrusions eliminate any leakage paths in the first end-stomp and the second end-stomp by forming the seals within the respective spaces between the respective sealing members and the respective interlocking members.

2. The reclosable vacuum-tight pouch of claim 1, further comprising a one-way valve disposed on at least one of the first and second pouch sidewalls.

3. The reclosable vacuum-tight pouch of claim 2, wherein at least one of the first and second pouch sidewalls comprises flow channels that are in fluid communication with the one-way valve.

4. The reclosable vacuum-tight pouch of claim 3, wherein the reclosable vacuum-tight pouch is provided as a component of a kit that comprises a vacuum pump to evacuate gas from the interior of the pouch through the one-way valve.

5. The reclosable vacuum-tight pouch of claim 1, wherein at least one of the first and second sealing reservoir protrusions is comprised of at least one of (i) a material that has a lower melting temperature than a majority portion of the first and second bases, and (ii) a material that is more compressible than a material that comprises a majority portion of the first and second bases.

6. The reclosable vacuum-tight pouch of claim 1, wherein the size of the first sealing reservoir protrusion and the size of the second sealing reservoir protrusion relates to the first separation distance of the first sealing member from the first interlocking profile and the second separation distance of the second sealing member from the fourth interlocking profile, respectively, such that a larger first sealing reservoir protrusion is provided with an increased first separation distance and a larger second sealing reservoir protrusion is provided with an increased second separation distance.

7. The reclosable vacuum-tight pouch of claim 1, wherein the size of the first sealing reservoir protrusion and the size of the second sealing reservoir protrusion relates to the first separation distance of the first sealing member from the first interlocking profile and the second separation distance of the second sealing member from the fourth interlocking profile, respectively, such that a smaller first sealing reservoir protrusion is provided with a decreased first separation distance and a smaller second sealing reservoir protrusion is provided with a decreased second separation distance.

8. The reclosable vacuum-tight pouch of claim 1, wherein the first sealing reservoir protrusion extends (a) a first distance from the first base towards the second base, and (b) a second distance parallel to the first base, wherein (i) the first distance provides that the first sealing reservoir protrusion is spaced from the second base, (ii) the second distance relates to the first separation distance of the first sealing member from the first interlocking profile, such that the first sealing reservoir protrusion is spaced from the first sealing member and the first interlocking profile, and (iii) the first and second distances provide that the first sealing reservoir protrusion forms the seal within the space between the first sealing member and the first interlocking profile.

9. The reclosable vacuum-tight pouch of claim 1, wherein the second sealing reservoir protrusion extends (a) a first distance from the second base towards the first base, and (b) a second distance parallel to the second base, wherein (i) the first distance provides that the second sealing reservoir protrusion is spaced from the first base, (ii) the second distance relates to the second separation distance of the second sealing member from the fourth interlocking profile, such that the second sealing reservoir protrusion is spaced from the second sealing member and the fourth interlocking profile, and (iii) the first and second distances provide that the second sealing reservoir protrusion forms the seal within the space between the second sealing member and the fourth interlocking profile.

10. The reclosable vacuum-tight pouch of claim 1, wherein at least one of the first and second sealing members is comprised of a material that is more compressible than a material that comprises a majority portion of the closure mechanism.

11. The reclosable vacuum-tight pouch of claim 1, wherein at least one of the first and second sealing reservoir protrusions is comprised of a material that has a lower melting temperature than a material that comprises a majority portion of the closure mechanism.

12. The reclosable vacuum-tight pouch of claim 1, wherein the fourth flange is attached to the second sidewall and the second flange is unattached to the first sidewall to prevent the interlocking profiles from deoccluding in response to an increase in pressure in the interior of the pouch.

13. The reclosable vacuum-tight pouch of claim 1, wherein the first base is unattached to the first sidewall of the pouch in a portion of the first base that extends from the first interlocking profile to the interior end of the first base.

14. The reclosable vacuum-tight pouch of claim 13, wherein the second base is unattached to the second sidewall of the pouch in a portion of the second base that extends from the third interlocking profile to the fourth interlocking profile.

15. The reclosable vacuum-tight pouch of claim 1, wherein:

(a) a first maximum occlusion distance is measured between the first and second bases, when the first and second bases are farthest apart from each other and (i) the first and third interlocking profiles are in an occluded state, and (ii) the first and second sealing members are sealingly engaged, and (b) a second maximum occlusion distance is measured between the first and second bases, when the first and second bases are farthest apart from each another and (i) the second and fourth interlocking profiles are in an occluded state, and (ii) the first and second sealing members are sealingly engaged, such that a sum of the first length of the first sealing member and the second length of the second sealing member is greater than or about equal to the greater of the first and second maximum occlusion distances.

* * * * *